US007841900B2

(12) United States Patent
Liu et al.

(10) Patent No.: US 7,841,900 B2
(45) Date of Patent: Nov. 30, 2010

(54) HIGH SPEED ELECTRICAL CONNECTOR HAVING IMPROVED HOUSING FOR HARBORING PRELOADED CONTACT

(75) Inventors: Hong-Tao Liu, Kunshan (CN); Chih-Ming Chien, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/512,346

(22) Filed: Jul. 30, 2009

(65) Prior Publication Data

US 2010/0035470 A1 Feb. 11, 2010

(51) Int. Cl.
*H01R 13/648* (2006.01)

(52) U.S. Cl. ..... 439/607.07

(58) Field of Classification Search ..... 439/607.07, 439/607.1, 79, 76.1, 752, 595
See application file for complete search history.

(56) References Cited

U.S. PATENT DOCUMENTS 6,299,483 B1 10/2001 Cohen et al.
6,371,813 B2 * 4/2002 Ramey et al. ..... 439/607.05
6,379,188 B1 * 4/2002 Cohen et al. ..... 439/607.07
6,503,103 B1 * 1/2003 Cohen et al. ..... 439/607.09
6,506,076 B2 * 1/2003 Cohen et al. ..... 439/607.09
6,780,069 B2 * 8/2004 Scherer et al. ..... 439/752
7,048,585 B2 * 5/2006 Milbrand et al. ..... 439/607.09
7,744,414 B2 * 6/2010 Scherer et al. ..... 439/607.05
2002/0111068 A1 * 8/2002 Cohen et al. ..... 439/608

* cited by examiner

*Primary Examiner*—Jean F Duverne
(74) *Attorney, Agent, or Firm*—Ming Chieh Chang; Wei Te Chung; Andrew C. Cheng

(57) ABSTRACT

An electrical connector (300) includes a number of wafers (30) and each wafer including an insulative housing (31) and a number of contacts (32). The housing defines a mating surface (311) and a mounting surface (312), and a plurality of passages (313) concaved from the mounting surface. The housing has a platform (314) formed in each passage and two cavities (315) defined on opposite sides of the platform. The platform has a pair of protruding portions (316) disposed above the cavities respectively. Each cavity has an opening (317) defined in the mounting surface. The contacts are received in the passages of the insulative housing. Each contact includes a receptacle (321) formed with a pair of legs (324). Each leg has a preloaded portion (325). The preloaded portion is insertable into the cavity via the opening along a mounting direction perpendicular to the mounting surface while spreading out the legs.

12 Claims, 6 Drawing Sheets

HIGH SPEED ELECTRICAL CONNECTOR HAVING IMPROVED HOUSING FOR HARBORING PRELOADED CONTACT

BACKGROUND OF THE INVENTION

1. Field of the Invention

The present invention relates to an electrical connector for transmitting high speed signal, and more particularly to an electrical connector having an improved housing for harboring preloaded contacts.

2. Description of the Prior Art

U.S. Pat. No. 6,299,483 issued to Cohen on Oct. 9, 2001 discloses a high speed electrical connector assembly for use with printed circuit boards. The connector assembly includes a first piece and a second piece. The first piece has a plurality of pins and shielding plates. The second piece includes a plurality of wafers aligned in parallel fashion. Each wafer includes a shielding plate and a first insulative housing molded over a portion of the shield plate, the first insulative housing having a plurality of cavities defined therein. The wafer further has a plurality of contacts molded in a second insulative housing. Each contact has a receptacle inserted into one of the cavities of the first insulative housing. Each cavity has a platform at its bottom. The receptacle is formed with two legs each having a preloaded portion formed at a front end thereof. The two legs fit on opposite side of the platform when receptacles are inserted in the passage. The receptacle has a distance between the two legs smaller than the width of the platform.

When assembling the receptacles into the cavities, it is therefore necessary to use a tool to spread out the legs of the receptacles firstly. Then, the preloaded portions are inserted into the cavities along a direction extending at an acute angle to the first insulative housing. Finally, the receptacles are inserted into the cavities. The assembling process of the wafer is complex.

Hence, an improved high speed electrical connector is needed to solve the above problem.

BRIEF SUMMARY OF THE INVENTION

One object of the present invention is to provide an electrical connector having an improved housing to easily assemble preloaded contacts.

In order to achieve the object set forth, an electrical connector includes a plurality of wafers and each wafer including an insulative housing and a plurality of contacts. The insulative housing defines a mating surface and a mounting surface, and a plurality of passages concaved from the mounting surface. The insulative housing has a platform formed in each passage and two cavities defined on opposite sides of the platform. The platform has a pair of protruding portions disposed above the cavities respectively. Each cavity has an opening defined in the mounting surface. The contacts are received in the passages of the insulative housing. Each contact includes a receptacle formed with a pair of legs. Each leg has a preloaded portion. The preloaded portion is insertable into the cavity via the opening along a mounting direction perpendicular to the mounting surface while spreading out the legs.

The contacts could be press-fit into the passages of the insulative housing directly while inserting the preloaded portions into the cavities via the opening along a vertical direction. It is easy to assemble the contacts to the insulative housing.

Other objects, advantages and novel features of the invention will become more apparent from the following detailed description of the present embodiments when taken in conjunction with the accompanying drawings.

DETAILED DESCRIPTION OF THE INVENTION

Figure 1:
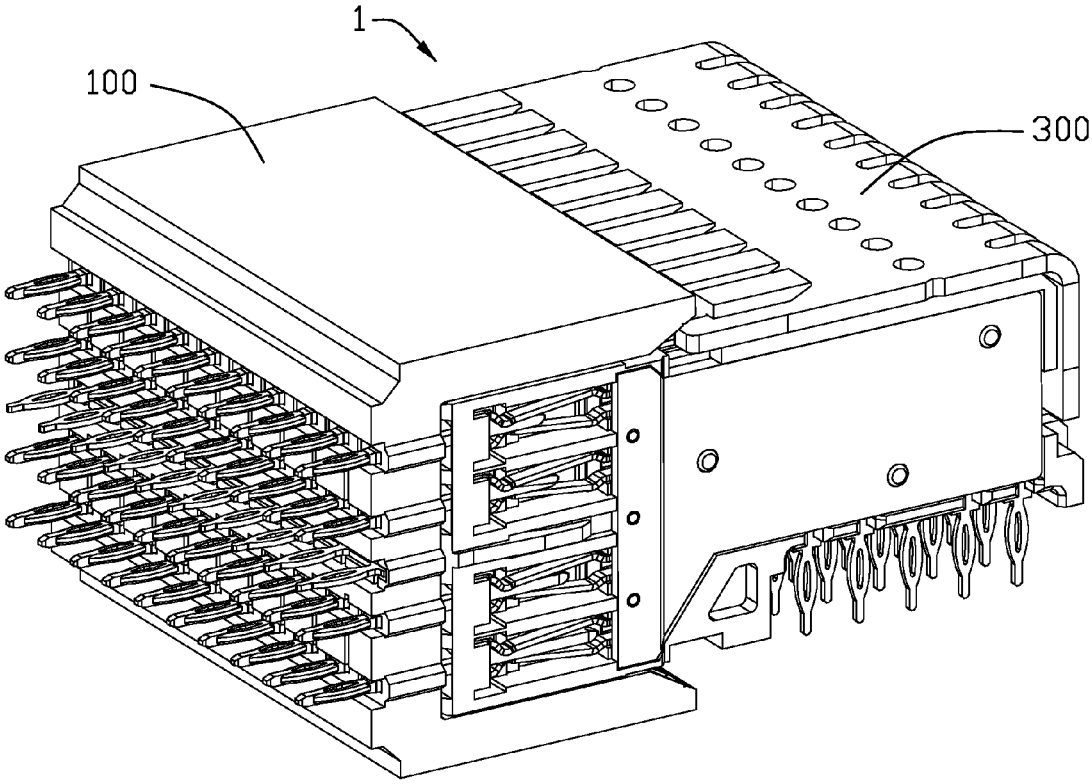
FIG. 1 is an assembled perspective view of an electrical connector assembly in accordance with the present invention.

Reference will now be made to the drawing figures to describe the present invention in detail. FIGS. 1-6 show a high speed electrical connector assembly 1. The electrical connector assembly 1 includes a first connector 100 and a second connector 300. The first connector 100 is attached to a backplane (not shown). The second connector 300 is attached to a daughter card (not shown).

Figure 2:
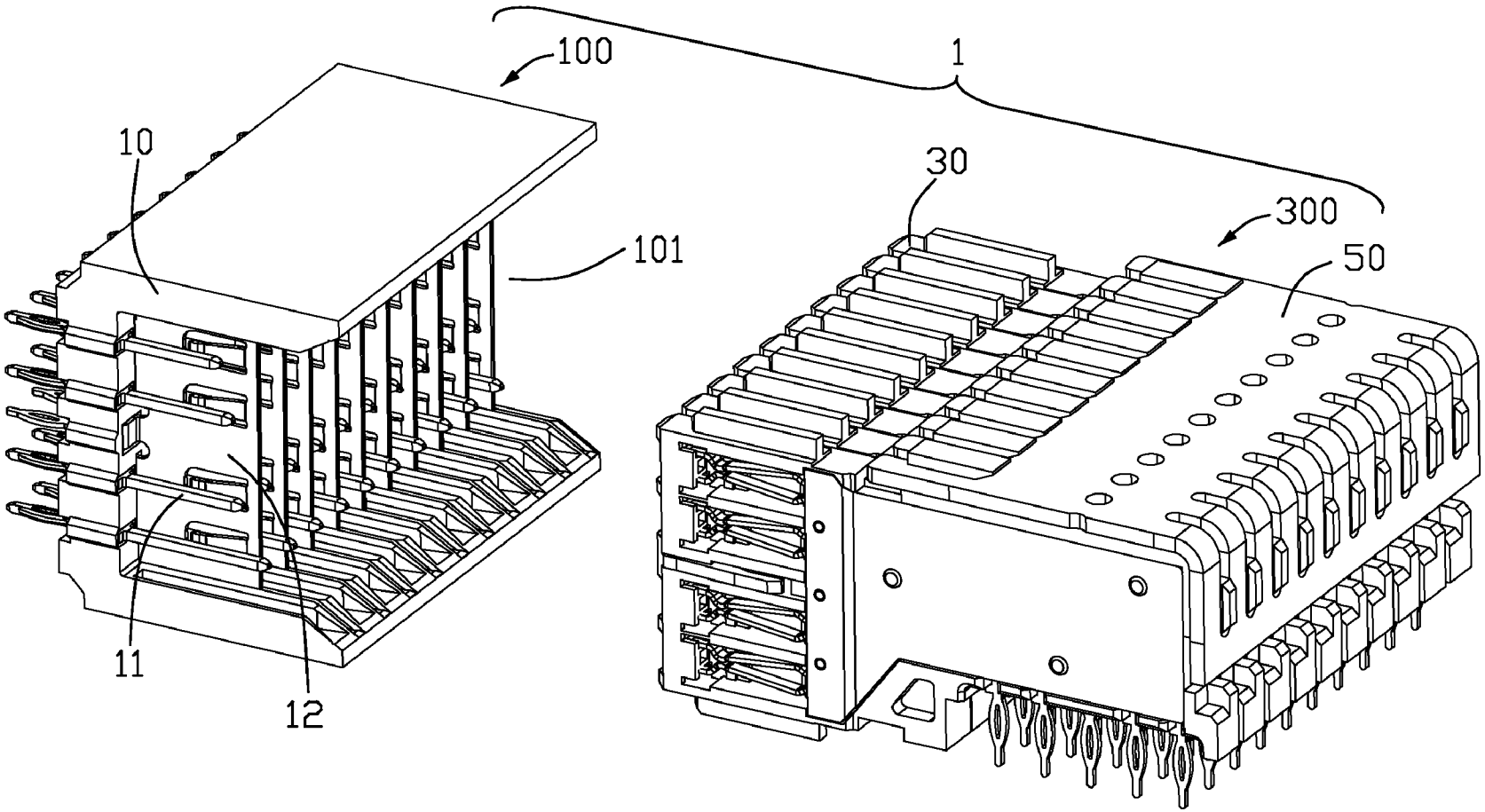
FIG. 2 is a perspective view of a first connector and a second connector of the electrical connector assembly as shown in FIG. 1.
Figure 3:
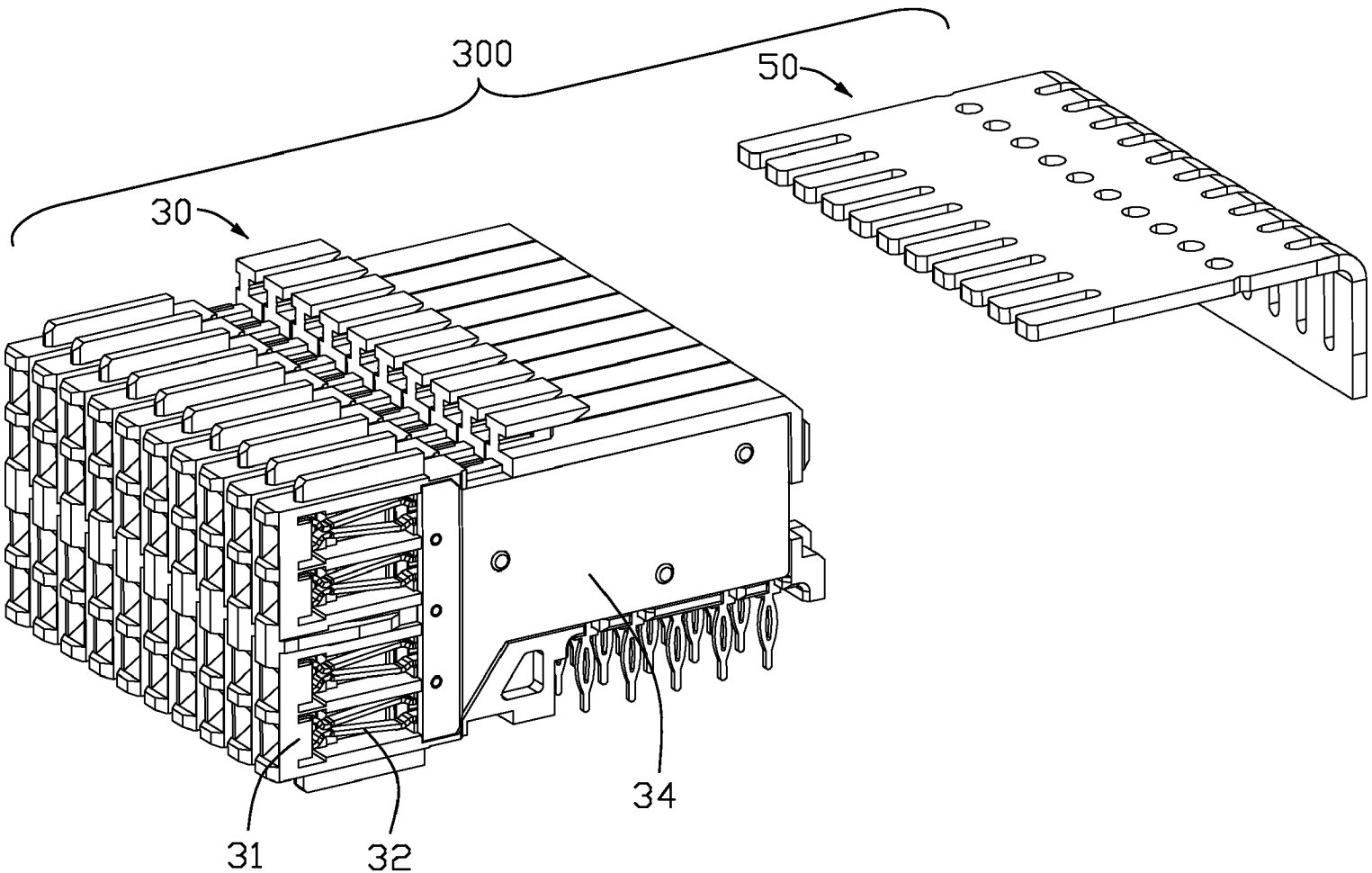
FIG. 3 is a perspective view of the second connector as shown in FIG. 2, when a stiffener has not been mounted on the wafers of the second connector.

Referring to FIGS. 1 and 2, the first connector 100 comprises a shroud 10 defining a receiving space 101, a plurality of pins 11 and shielding members 12 retained in the receiving space 101. The shroud 10 is preferably injection molded from a plastic, polyester or other proper insulative material. The pins 11 are retained in the shroud 10 in columns. The shielding members 12 are retained in the shroud 10 in parallel arrangement. Each shielding member 12 is disposed adjacent to a column of pins 11.

Referring to FIGS. 1-3 and 5, the second connector 300 comprises a plurality of wafers 30 and a stiffener 50 mounted on the wafers 30. The wafers 30 are stacked side-by-side and tied together by the stiffener 50. The stiffener 50 is preferably stamped and formed from a metal strip. Each wafer 30 includes an insulative housing 31, a column of contacts 32, a shielding plate 33 and an insulative cover 34.

Figure 5:
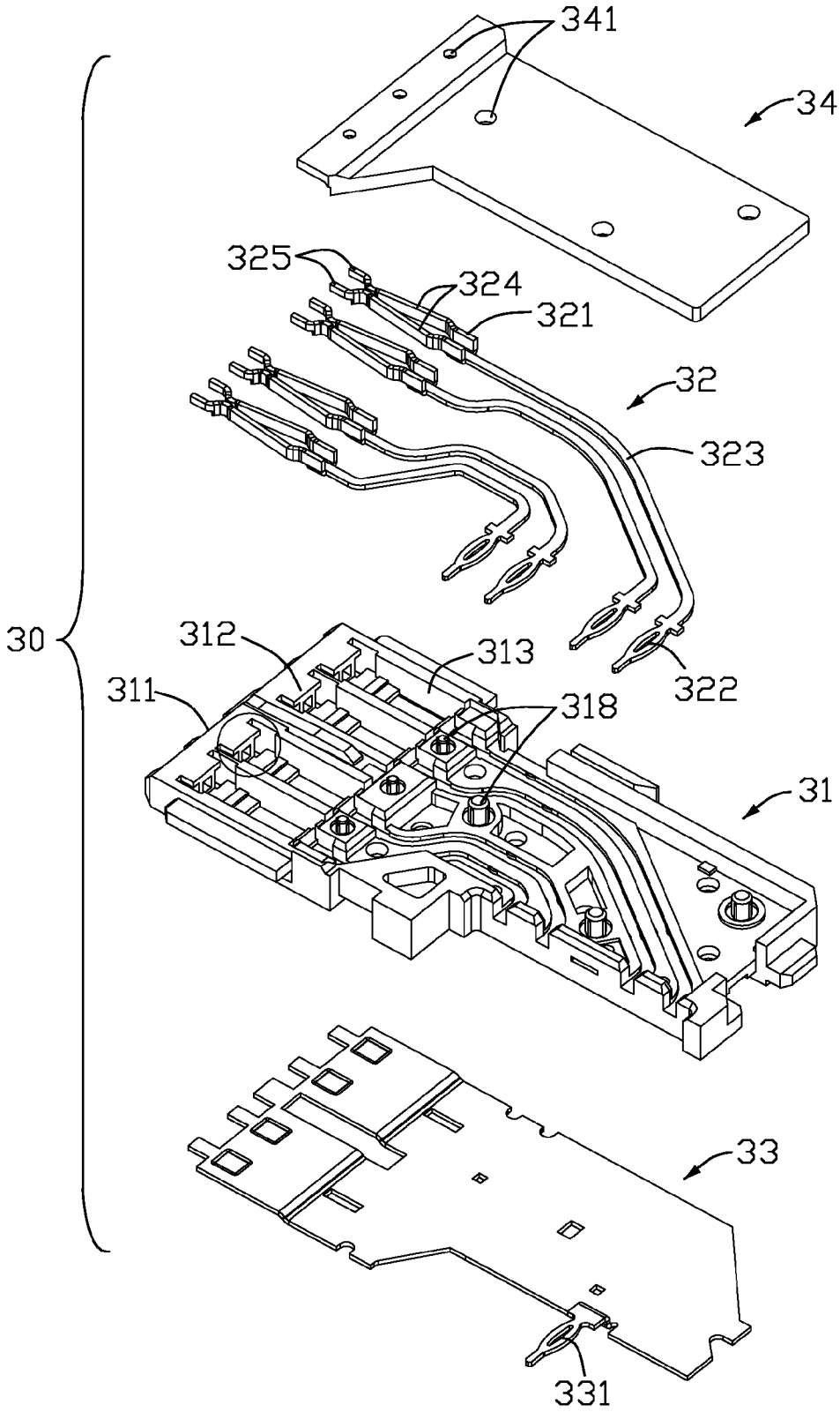
FIG. 5 is an exploded view of the wafer as shown in FIG. 4.
Figure 6:
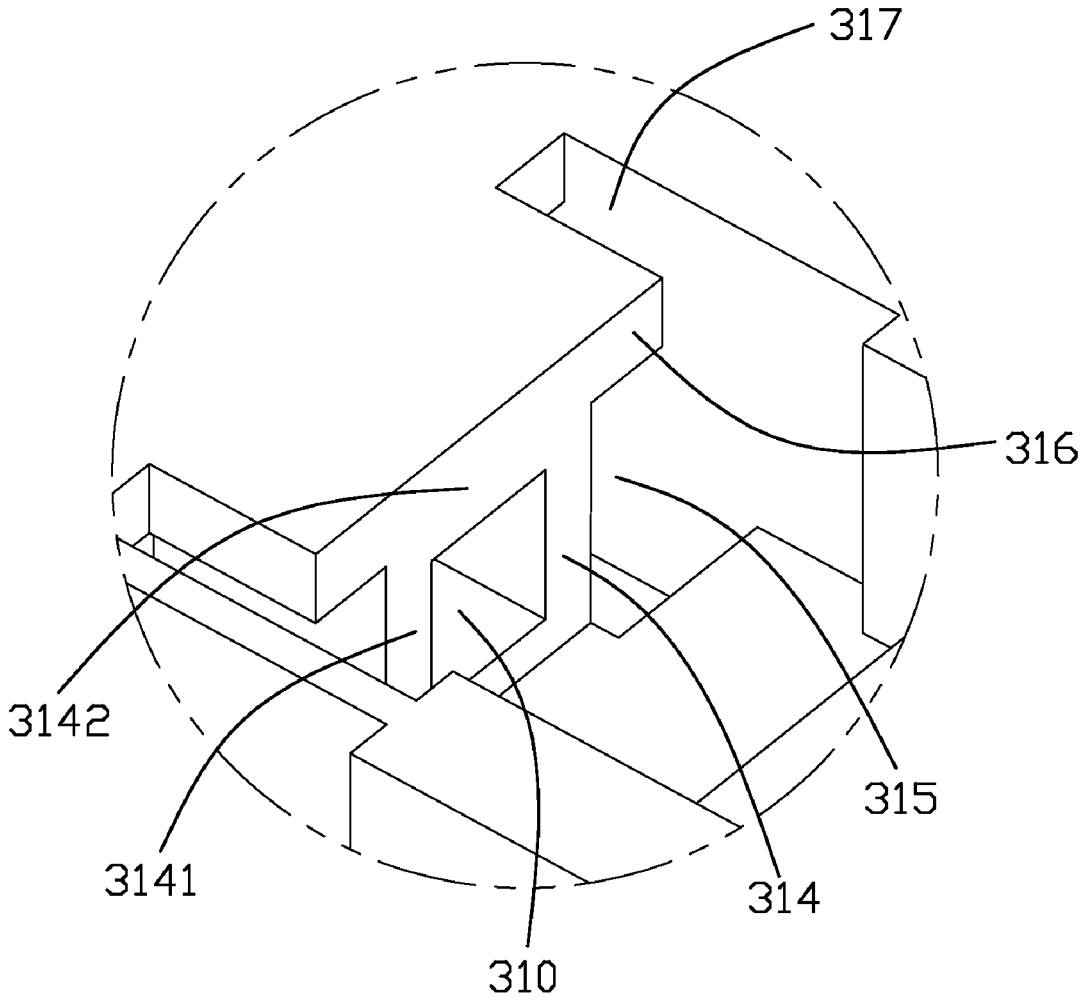
FIG. 6 is a magnifying view showing a platform of an insulative housing of the wafer, as especially labeled in FIG. 5.

Referring to FIGS. 5 and 6, the insulative housing 31 is substantially rectangular shaped. The insulative housing 31 has a mating surface 311 and a mounting surface 312 perpendicular to the mating surface 311, and a plurality of passages 313 concaved from the mounting surface 312. The passages 313 are shaped to receive the contacts 32. The insulative housing 31 has a platform 314 disposed in each passage 313 and two cavities 315 defined on opposite sides of the platform 314. The platform 314 has a pair of side walls 3141, a top wall 3142 and an engaging hole 310 defined between the pair of side walls 3141. The engaging hole 310 extends through the mating surface 311 and communicates with the passage 313 for insertion of the pin 11 of the mating connector 100. The platform 314 has a pair of protruding portions 316 formed on the top wall 3142 and disposed above the cavities 315 respectively. Each cavity 315 has an opening 317 defined in the mounting surface 312 and adjacent to each protruding portion 316. The opening 317 extends through the mounting surface 312 and communicates with the cavity 315. The insulative housing 31 also has a plurality of fixing posts 318 formed on the mounting surface 312 for holding the insulative cover 34.

Figure 4:
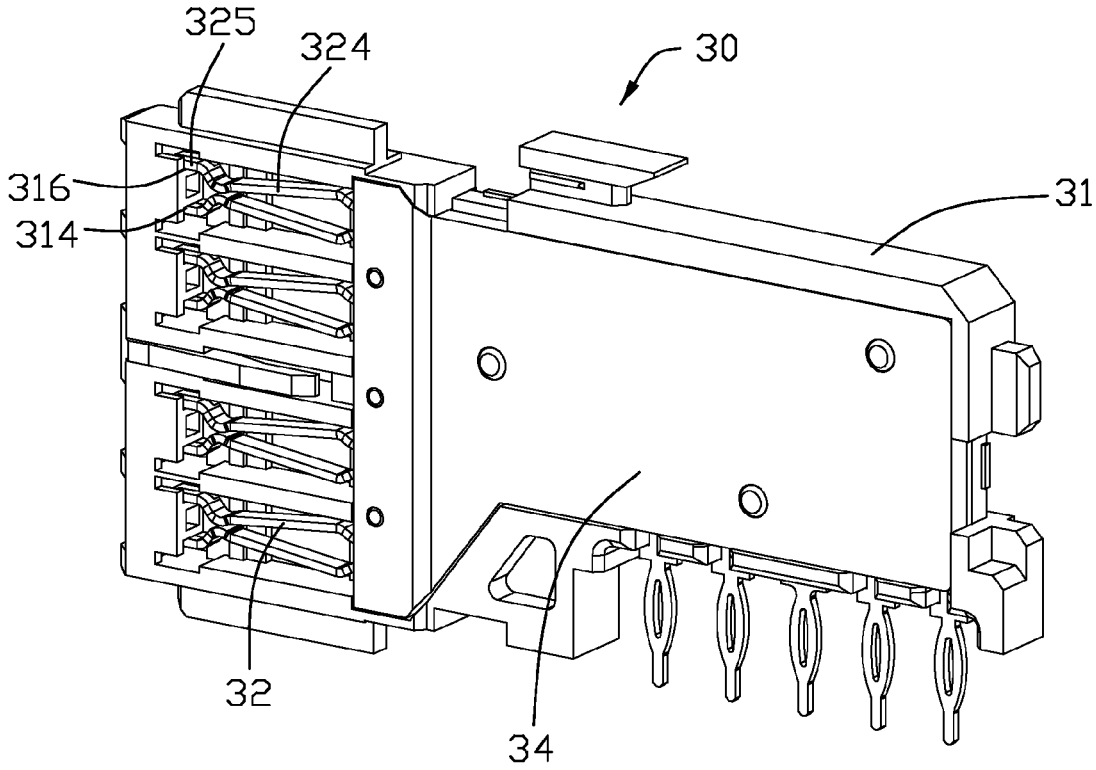
FIG. 4 is a perspective view of a wafer of the second connector as shown in FIG. 2.

Referring to FIGS. 4-6, each contact 32 is substantially right-angled. The contact 32 includes a receptacle 321, a tail portion 322 and an interconnected portion 323 connected with the receptacle 321 and the tail portion 322. The receptacle 321 is formed with a pair of legs 324. When the pin 11 of the first connector 100 engages with the receptacle 321 of the contacts 32, the pin 11 is sandwiched between the pair of legs 324 of the receptacle 321. Each leg 324 has a preloaded portion 325 formed on a free end thereof. The preloaded portion 325 is inserted into the cavity 315 via the opening 317. The preloaded portion 325 resists against the platform 314 and is disposed below the protruding portion 316. The preloaded portion 325 is secured in cavity 315 and prevented from leaving away from the cavity 315 due to the protruding portion 316. The tail portions 322 are adapt to be pressed into holes (not shown) defined on the daughter card.

The receptacle 321 of the contact 32 has a distance between the pair of legs 324 smaller than that of the pair of side walls 3141 of the platform 314. Before inserting the contact 32 into the passage 313, the legs 324 are spread outwardly by a tool firstly. Then the contact 32 is inserted into the passage 313 of the insulative housing 31 along a mounting direction perpendicular to the mounting surface 312. The preloaded portion 325 of the legs 32 could be press fit into the cavity 315 via the opening 317 along the mounting direction. When the preloaded portions 325 are received in the cavity 315, the legs 324 respectively resist against the side walls 3141 of the platform 314 and are disposed under the protruding portions 316.

Referring to FIG. 5, the shielding plate 33 is substantially rectangular shaped. The shielding plate 33 is formed in the insulative housing 31 by insert molding. The shielding plate 33 has a grounding tail 331 formed at a lower edge for being mounted on the daughter card.

Referring to FIG. 5, the insulative cover 34 is attached to the insulative housing 31 and covering the interconnected portions 323 of the contacts 32. The insulative cover 34 has a plurality of through holes 341 defined thereon for insertion of the fixing posts 318 of the insulative housing 31.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

a plurality of wafers aligned in parallel fashion, each wafer comprising:

an insulative housing defining a mating surface and a mounting surface perpendicular to the mating surface, a plurality of passages concaved from the mounting surface, the insulative housing having a platform formed in each passage and two cavities defined on opposite sides of the platform, the platform having a pair of protruding portions formed thereon and disposed above the cavities respectively, each cavity having an opening defined in the mounting surface; and a plurality of contacts received in the passages of the insulative housing, each contact comprising a receptacle formed with a pair of legs, each leg having a preloaded portion, the preloaded portion being insertable into the cavity via the opening along a mounting direction perpendicular to the mounting surface while spreading out the legs; wherein said platform is formed with a pair of side walls, the distance between the side walls is larger than the distance between the pair of the legs, and said preloaded portions of the legs respectively resist against the side walls; wherein said platform defines an engaging hole between the pair of the side walls, the engaging hole extending through the mating surface and communicating with the passage for insertion of a pin of a mating connector.

2. The electrical connector as claimed in claim 1, wherein said preloaded portion is disposed below the protruding portion.

3. The electrical connector as claimed in claim 1, wherein each contact is substantially right-angled, and comprises a tail portion for being mounted on a printed circuit board and an interconnected portion connected with the tail portion and the receptacle.

4. The electrical connector as claimed in claim 3, wherein said wafer further comprises an insulative cover mounted on the insulative housing and covering the interconnected portions of the contacts.

5. The electrical connector as claimed in claim 1, wherein said wafer further comprises a shielding plate molded with the insulative housing.

6. The electrical connector as claimed in claim 1, further comprising a stiffener supporting the wafers and connecting the wafers together.

7. An electrical connector assembly comprising:

a first connector comprising a shroud defining a receiving space and a plurality of pins disposed in the receiving space; and a second connector comprising a plurality of wafers for inserting into the receiving space of the first connector, each wafer comprising:

an insulative housing defining a mating surface and a mounting surface perpendicular to the mating surface, a plurality of passages concaved from the mounting surface, the insulative housing having a platform formed in each passage and two cavities defined on opposite sides of the platform, the platform having a pair of protruding portions formed thereon and disposed above the cavities respectively, each cavity having an opening defined in the mounting surface; and a plurality of contacts received in the passages of the insulative housing, each contact comprising a receptacle formed with a pair of legs, each leg having a preloaded portion, the preloaded portion being insertable into the cavity via the opening along a mounting direction perpendicular to the mounting surface while spreading out the legs; wherein said platform is formed with a pair of side walls, the distance between the side walls is larger than the distance between the pair of the legs, and said preloaded portions of the legs respectively resist against the side walls; wherein said platform defines an engaging hole between the pair of the side walls, the engaging hole extending through the mating surface and communicating with the passage for insertion of a pin of a mating connector.

8. The electrical connector assembly as claimed in claim 7, wherein said preloaded portion is disposed below the protruding portion.

9. The electrical connector assembly as claimed in claim 7, wherein each contact is substantially right-angled, and comprises a tail portion for being mounted on a printed circuit board and an interconnected portion connected with the tail portion and the receptacle.

10. The electrical connector assembly as claimed in claim 9, wherein said wafer further comprises an insulative cover mounted on the insulative housing and covering the interconnected portions of the contacts.

11. An electrical connector assembly comprising:

a plurality of wafers side by side intimately stacked with one another;

each of said wafer including an insulative housing defining a front connector mating port and a rear board mounting port in a front-to-back direction, and two opposite transverse surfaces in a thickness direction perpendicular to said front-to-back direction;

a plurality of non-linear passageways defined in the housing and communicating said mating port and the board mounting port, said passageways extending through one of said two opposite transverse surfaces; and a plurality of contacts assembled into the corresponding passageways, respectively, along said thickness direction through said one of the transverse surfaces, each of said contacts defining a contacting section with a preloaded portion at a free end thereof; wherein a protruding portion is formed on said one of the two opposite surfaces to shield said preloaded portion along said thickness direction after said preloaded portion is moved to a final preloaded position after assembled; wherein the other of said two opposite surfaces defines therein an opening in alignment with said protruding portion in said thickness direction so as to form said protruding portion during injection molding said wafer; wherein said housing defines a platform in front of the corresponding passageway and between said protruding portion and said opening in said thickness direction, which said preloaded portion abuts against; wherein said one of the two opposite surfaces defines another opening beside said protruding portion in a vertical direction so as to allow the corresponding preloaded portion to pass therethrough during assembling and successively moved to the final preloaded position behind the protruding portion; wherein said preloaded portion is forcibly deflected during passing through said another opening.

12. The electrical connector assembly as claimed in claim 11, wherein the platform defines two opposite side in a vertical direction, and the preloaded portion of the contact abuts against one of said two opposite sides under condition that said wafer defines an engaging hole by the other of said two opposite sides for receiving a pin type contact of the complementary connector.

* * * * *